United States Patent [19]

Parlour et al.

[11] 4,399,596

[45] Aug. 23, 1983

[54] COFFINS

[76] Inventors: Henry W. Parlour, 42 The Woodlands, Market Harborough; Paul A. Ginns, 2 Newbold Rd., Desford, both of Leicestershire, England

[21] Appl. No.: 320,969

[22] PCT Filed: Jan. 13, 1981

[86] PCT No.: PCT/GB81/00004

§ 371 Date: Nov. 2, 1981

§ 102(e) Date: Nov. 2, 1981

[87] PCT Pub. No.: WO81/02669

PCT Pub. Date: Oct. 1, 1981

[51] Int. Cl.[3] ..... A61G 17/00

[52] U.S. Cl. ..... 27/4

[58] Field of Search ..... 27/2, 4

[56] References Cited

U.S. PATENT DOCUMENTS

| | | | |
|---|---|---|---|
| 768,481 | 8/1904 | Post | 27/2 |
| 3,220,080 | 11/1965 | Connelly | 27/2 |
| 3,969,798 | 7/1976 | Sahlin | 27/4 |
| 4,123,831 | 11/1978 | Covington | 27/4 |

FOREIGN PATENT DOCUMENTS

| | | | |
|---|---|---|---|
| 2013739 | 10/1971 | Fed. Rep. of Germany | 27/4 |
| 1190760 | 5/1970 | United Kingdom | 27/4 |

*Primary Examiner*—John D. Yasko

*Attorney, Agent, or Firm*—Kalish & Gilster

[57] ABSTRACT

A blank for erection into a coffin for the disposal of a human corpse is cut from a sheet of cardboard. It comprises a base (B) with ends pieces (C,D) and sides (E,F), the end pieces having lateral extensions (CC,DD), all integral yet separated by crease lines. The sides (E,F) have ends (e,f) cut into the adjacent extensions (CC,DD) at angles such as each to give an upright corner in the erected coffin. The extensions (CC,DD) are connected to the insides of the adjacent sides (E,F). A separate coffin lid fits down inside the coffin lid and rests on strengthening strips (A) adhering to the inside of the coffin. Depending upon configuration, the base and/or side pieces have free edges cut out in dove-tailed or mating segments for joining together the edges upon erection of the blank into the coffin.

10 Claims, 16 Drawing Figures

COFFINS

DESCRIPTION

The invention relates to coffins for the disposal of animal or human remains. These coffins are made of cardboard, fibre board, straw-type building board or hard board. Such materials are readily and inexpensively available, whereas there is a world shortage of suitable wood, and can reproducibly be cut in the necessary sizes without any need for matching. They are suitable for cremation and also for burial as they do not give rise to poisonous gases on burning, and decompose rapidly in the soil.

Cardboard coffins have previously been proposed, but it has proved difficult to design a model which can readily be erected to give the appearance of a conventional wooden coffin, and also have the necessary strength. An example of this is in U.K. Patent Specification No. 1,190,760, in which a moulding is provided around the periphery of the base so as not to impair the appearance of the coffin, and sufficient strength could not be obtained from cardboard of acceptable thickness. The problem of appearance particularly was faced in U.K. Patent Specification Nos. 1,291,836 and 1,305,623 which show complicated arrangements involving backing sheets and inset wooden fillets in the corners of the coffin. Another proposal U.K. Patent Specification No. 1,535,188 involves a large number of different blanks for the assembly of a single coffin, and this would involve the user in holding a very large stock of panels of different sizes. The invention provides a coffin, or a blank for erection into a coffin, cut from a sheet and comprising a base, side pieces and end pieces integral yet separated by crease lines, the side or end pieces having lateral extensions and means for connecting the side and end pieces in the erected coffin whereby the extensions support the adjacent side or end pieces.

The side or end pieces are preferably cut into adjacent extensions at angles such as to give upright corners when connected in the erected coffin. The connections may be by means of butt joints, dovetails or other interlocking means, preferably assisted by adhesive or stapling. The connections are preferably between adjacent side and end pieces, but may be with the base or between lateral extensions from side or end pieces. In the erected coffin, the extensions support the side or end pieces generally by lying inside them and being connected to them.

Strengthening strips may be included in the coffin or blank for adhesion along the upper sides of the erected coffin. These strips may be of double thickness, and one of the thicknesses may be cut away between the other and the side of the coffin to which it is to adhere so as to provide slots for securing a coffin lid. Tapes may be made to adhere around the outside and extend through the sides of the coffin for tying over the corpse and supporting coffin handles thereby strengthening the structure.

The coffin may include a coffin lid which fits inside an upper edge of the coffin and is secured to the strengthening strips. The coffin lid preferably has tongues projecting from its periphery for securing in the slots between the strengthening strips and the coffin sides. The tongues preferably have an edge nearer the foot of the coffin perpendicular to the periphery of the lid, and an edge nearer the head of the coffin inclined at less than 90° to the periphery. The coffin lid preferably sits below the upper edge of the coffin to assist in retaining flowers.

A coffin according to the invention is preferably cut from a sheet of corrugated cardboard, single, double or treble fluted according to size, and faced with Kraft paper. A further coating of wood-effect or veneer paper may be applied to the outside before or after erection of the blank into a coffin. A coated paper may similarly be applied in or outside the coffin, or the cardboard may be waxed if desired. The blank may be cut using a cylindrical cutting machine, a set of knives for each size of coffin. Handles and reinforcement adhesive tapes may then be applied directly inside or outside the blank. The blank can be erected into a coffin in a short time whenever needed.

The upper edges of the coffin sides may be reinforced by folding over inwards or outwards to provide a double thickness.

DRAWINGS

Figure 12:
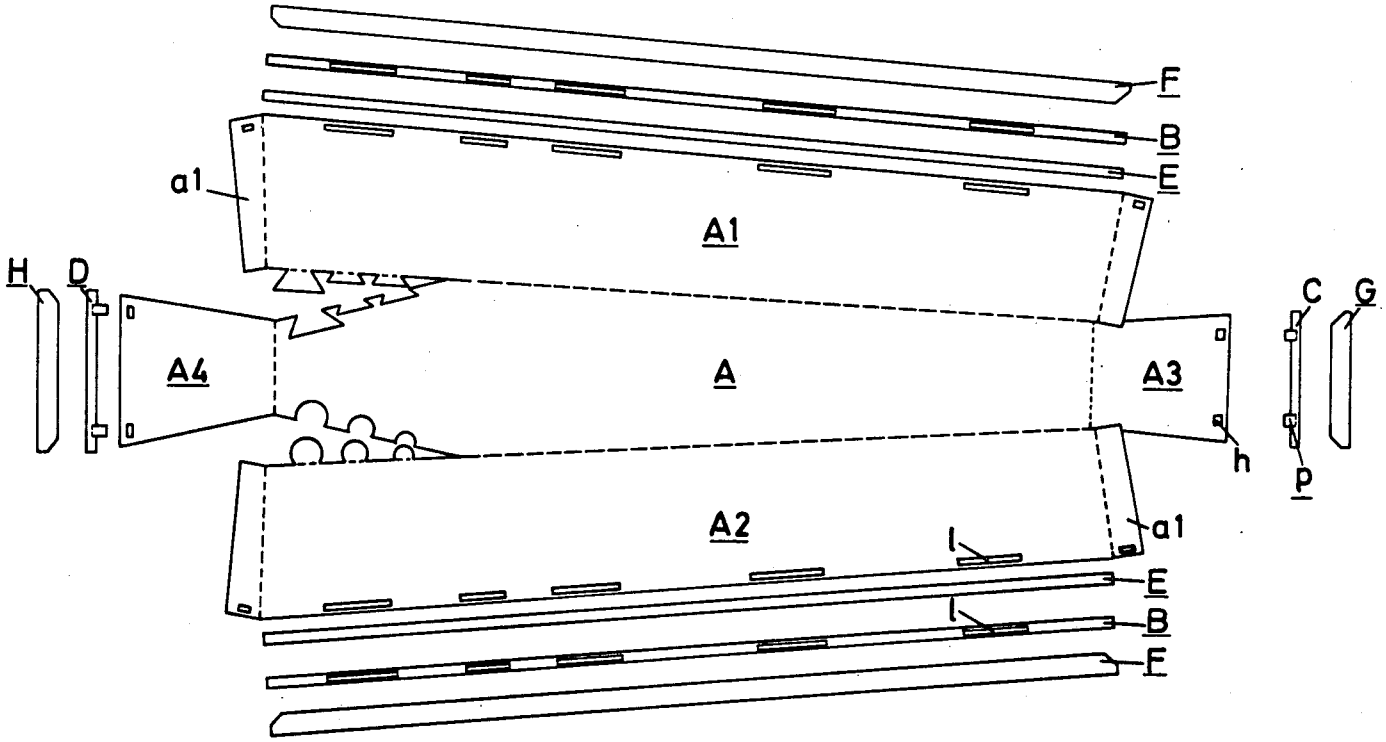
FIG. 12 is a plan view of a further blank.
Figure 13:
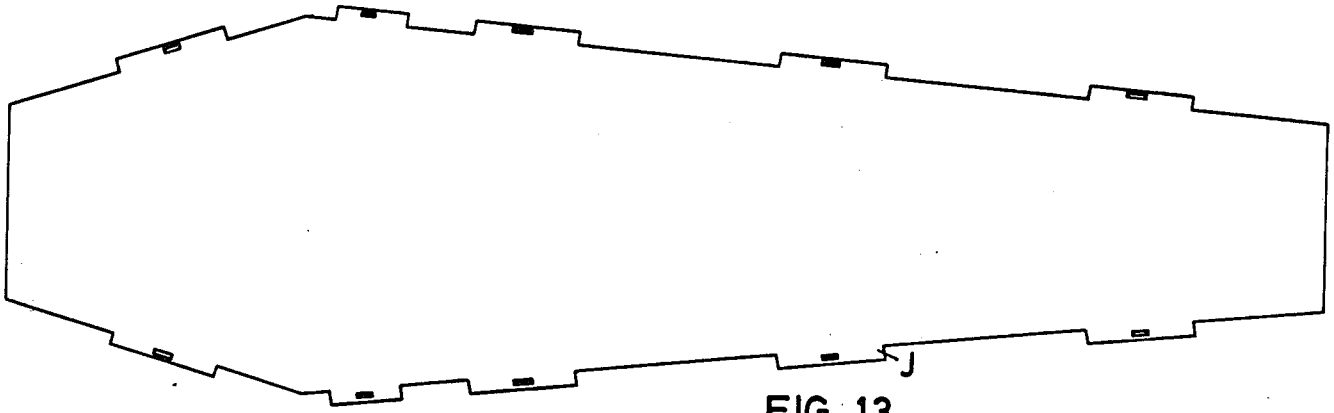
Figure 14:
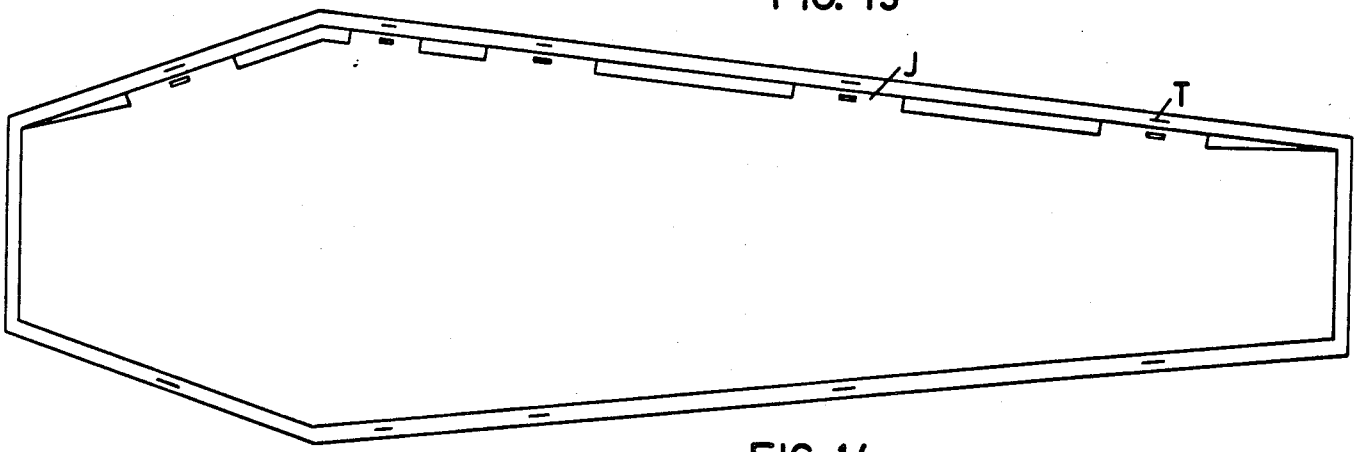

FIGS. **12*a* and 12*b*** are part sections illustrating the erection of the blank;

FIG. 13 is a plan of a lid for a coffin erected from the blank of FIG. 12; and FIG. 14 is a plan view illustrating the mounting of the lid of FIG. 13 on the coffin of FIG. 12.

Figure 1:
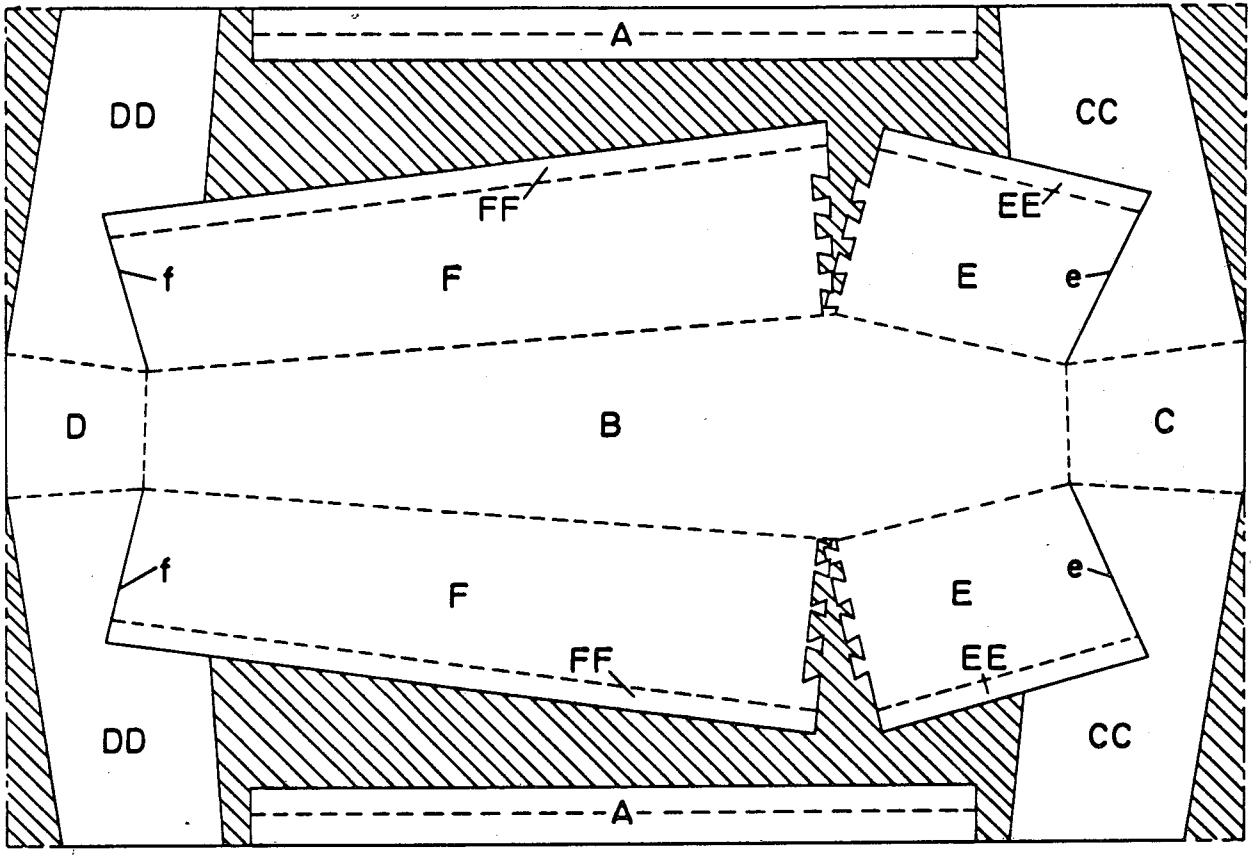
FIG. 1 is a plan view of a blank for erection into a coffin according to the invention.

In the Figures, a broken line indicates a crease and a solid line indicates a cut. In FIG. 1, hatching indicates cardboard cut away from the sheet and not used in the blank or in the coffin erected therefrom. A single set of reference numerals are used in FIGS. 1 to 11, but a different set in FIGS. 12 to 14.

Figure 4:
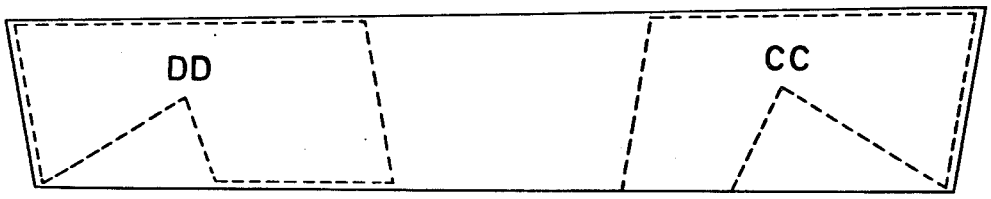
FIGS. 4, 5 and 6 are side views of the coffin of FIG. 2 with broken and solid lines to show the locations respectively of the side extensions, the connection between the upper and lower sides, and the strengthening strips in the erected coffin.
Figure 5:
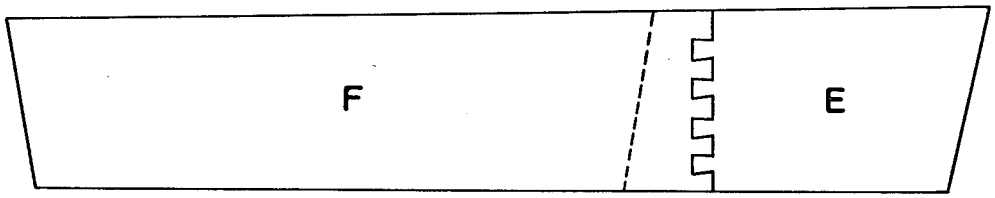
Figure 6:
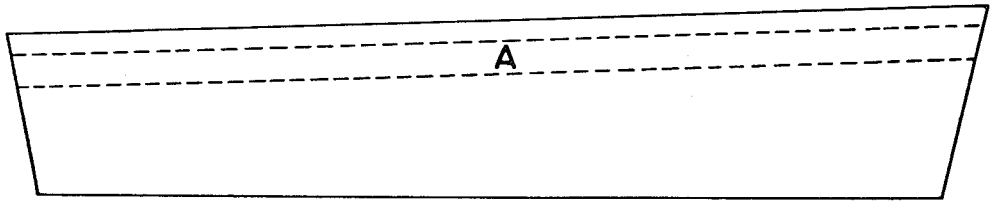

In FIG. 1, the blank comprises a base B, a head end piece C, upper sides E diverging from the head end to a shoulder portion, lower sides F converging from the shoulder portion to a foot end, and a foot end piece D. The head end piece C has lateral extensions CC, and the foot end piece D has later extensions DD. The base B, end pieces C,D, sides E,F, and extensions CC and DD are integral, being cut from a standard sheet of cardboard, yet separated by crease lines to facilitate folding so as to give the appearance of a conventional wooden coffin in the finally erected form. The sides E,F respectively have ends e,f cut into the adjacent extensions CC, DD at angles such as each to give an upright corner when connected to the end of an adjacent side or end in the erected coffin. The extensions CC,DD are connected to the insides of the adjacent sides E,F as shown in FIG. 4.

Figure 2:
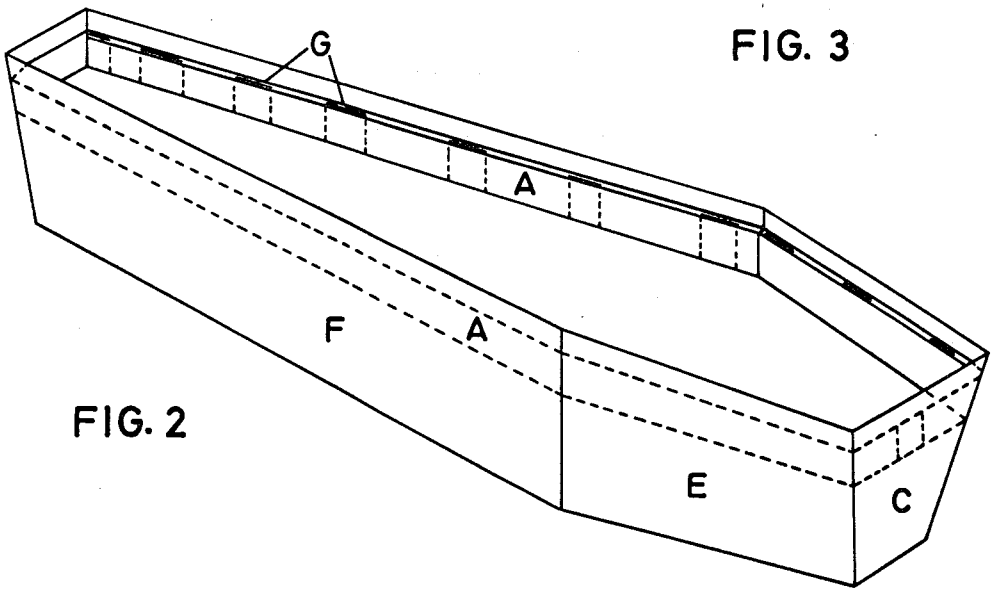
FIG. 2 is a perspective view of the blank of FIG. 1 erected into a coffin.
Figure 7:
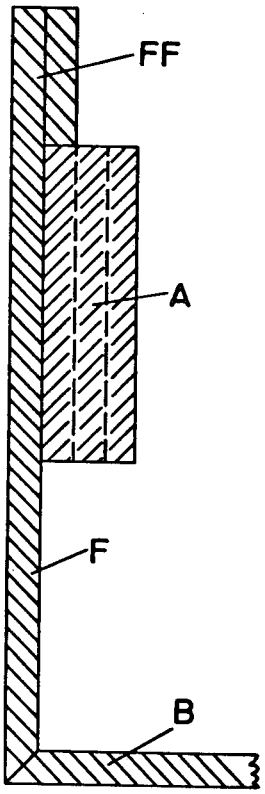
FIG. 7 is a section (not to scale) through a side of the coffin of FIG. 2.

Strengthening strips A are cut out from the longer sides of the cardboard sheet as shown in FIG. 1, and folded longitudinally along the central crease lines in order to double their thickness. One of the thicknesses is cut away (as could have been done when cutting the blank) so as to leave slots G between the other thickness and the side of the coffin to which the strip A is to adhere as shown in FIG. 2. Upper edges EE,FF respectively of the upper and lower sides E,F also are folded over to give a double thickness and help increase the strength of the erected coffin. The final arrangement of these double thickness parts is best seen in the section of FIG. 7. The coffin is erected from the blank shown in FIG. 1 to the form shown in FIG. 2 by folding the various parts inwards at the crease lines and connecting them together where appropriate with adhesives and/or staples. The double thickness portions are produced by folding and adhesion in the same way.

Figure 8:
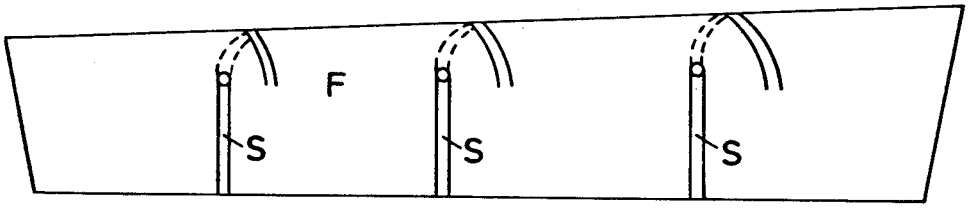
FIGS. 8 and 9 are further side views of the coffin of FIG. 2 illustrating the use of tapes for tying over the corpse and supporting coffin handles (not shown)
Figure 9:
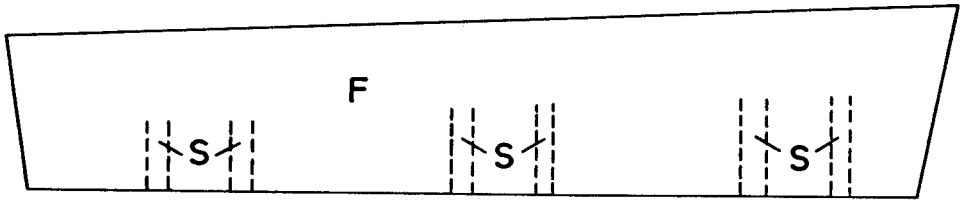
Figure 10:
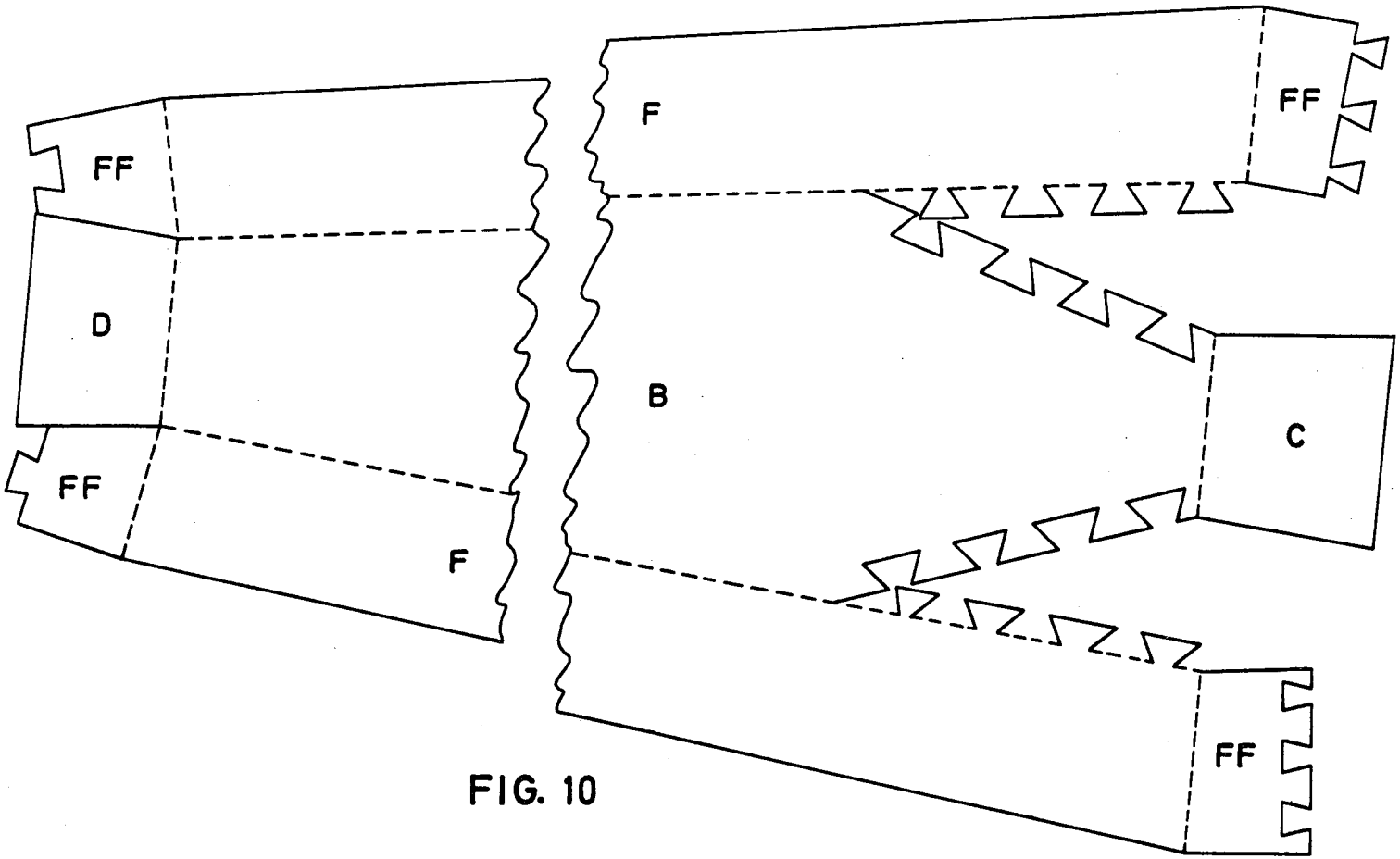
FIGS. 10 and 11 are plan views of modified blanks similar to that of FIG. 1.
Figure 11:
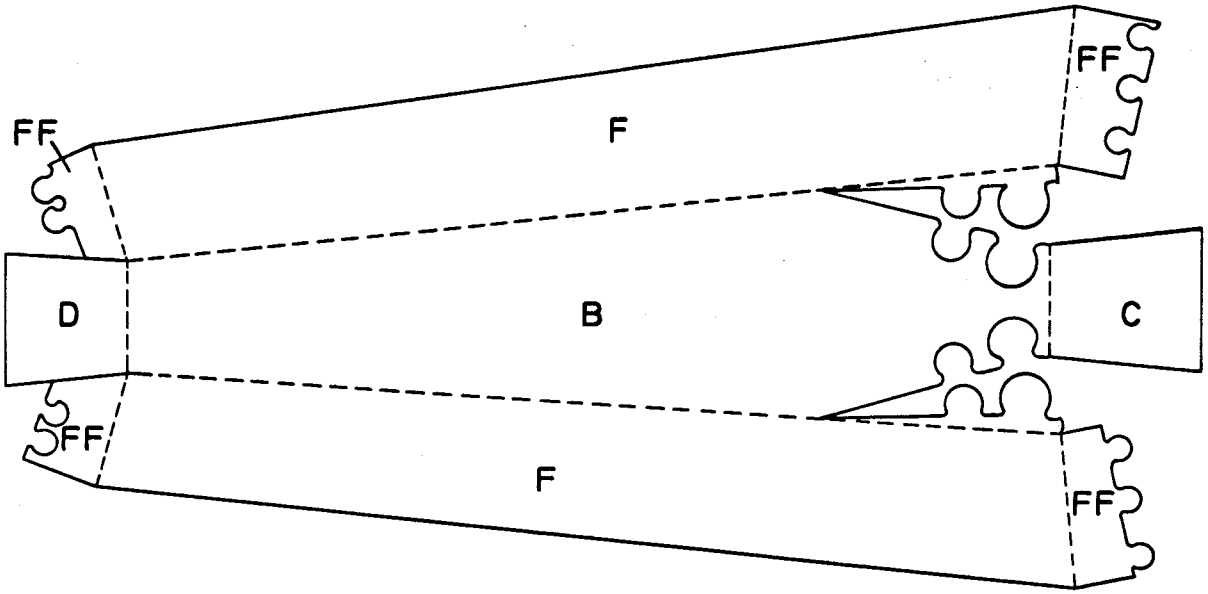

FIGS. 8 and 9 show alternative arrangements of tapes S adhering around the outside of the coffin and extending through holes in the sides for tying over the corpse and supporting coffin handles (not shown).

Figure 3:
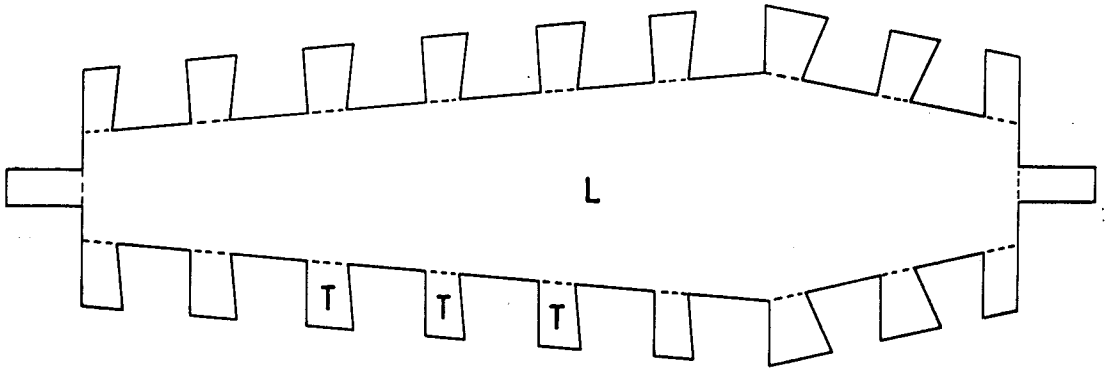
FIG. 3 is a plan view of a coffin lid for the coffin of FIG. 2.

FIG. 3 shows a lid L for fitting inside the top of the coffin shown in FIG. 2 and resting on top of the strengthening strips A. The coffin lid L has a number of tongues T projecting from its periphery for securing in the slots G cut in the strengthening strips A adjacent the insides of the sides of the coffin. The tongues T along the sides of the coffin lid L have an edge nearer the foot of the coffin perpendicular to the periphery of the coffin lid, and an edge nearer the head of the coffin inclined at 80° to the periphery.

This means that when the coffin lid L is applied to the coffin, it needs to be pressed inwards from the foot towards the head, and this makes the lid more difficult to remove. The coffin lid L sits below the upper edge of the coffin, leaving the sides upstanding to provide a ridge to help in retaining wreaths, flowers or other articles placed on top of the coffin.

Turning now to FIG. 12, the entire blank is cut from a single sheet of treble fluted cardboard faced with Kraft paper. A main piece comprises a base A, side pieces $A_1$, $A_2$ and end pieces $A_3$,$A_4$ integral yet separated by crease lines. The side pieces have lateral extensions such as $a_1$. The end pieces $A_3$,$A_4$ and the extensions such as $a_1$ have apertures h through them near the upper edges. The side and end pieces are thereby connected in the erected coffin. The extensions support the adjacent end pieces by means of adhesive on at least one of the interfaces between the extensions and the end pieces, and by pegs p passing through aligned apertures h.

At the left hand or head end, the base A is shown with alternative means, one at each side, for securing to the sides $A_1$,$A_2$, the former being cut out in dovetailed form and the latter in mating segments in the manner of a jig-saw puzzle.

The head and foot ends are supported at the top by key members D,C cut out of the full thickness of the cardboard. Each key member D,C comprises a bar for supporting the top of the end piece and two lateral projections cut and bent so as to stand up from the centre line of the bar and act as pegs p passing through the apertures h in the end piece $A_3$ or $A_4$, respectively. The key members C,D are covered, as shown in FIG. **12*b*** in respect of the foot end member C, with an adhering single fluted cardboard cover piece G or H respectively.

Figure 12A:
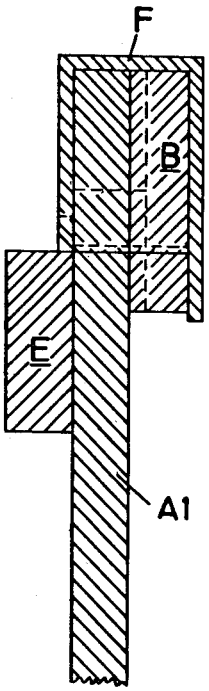
Figure 12B:
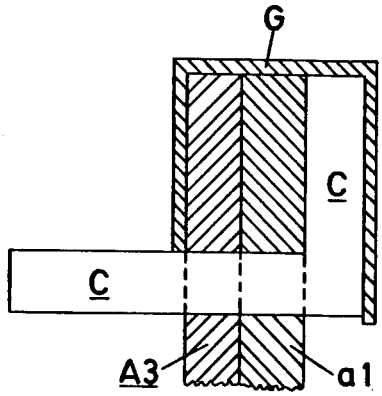

The side pieces $A_1$,$A_2$ are supported near the top by adhering strengthening strips B,E on the outside and inside respectively cut out of the full thickness of the cardboard as shown in FIG. **12*a*. The side pieces $A_1$,$A_2$ have a number of longitudinal slots 1 cut through them and the corresponding parts of the strips B for receiving locking tags J of the coffin lid (FIGS. 13, 14). The side pieces $A_1$,$A_2$ and strips B are covered as shown in FIG. 12*a* in respect of the side $A_1$ with an adhering single fluted cardboard cover piece F. The strips B also have a number of transverse slots t (FIG. 14**) for receiving locking tabs of single fluted cardboard for securing the coffin lid.

The coffin lid has its tags J inserted into the longitudinal slots 1 in the side $A_2$ and adhering strip B. The coffin is flexed so that the coffin lid drops down onto the strip E along the side $A_1$. The resilience of the coffin engages the tags J in the slots 1 in the side $A_1$. The coffin lid is then secured by the introduction (upwards or downwards) of locking tabs into the slots t in the strips B.

We claim:

1. A coffin erected from a blank cut from a single sheet of a material selected from the group consisting of cardboard, fibre board, straw-type building board or hard board, the blank comprising a base for forming the coffin floor, side pieces for forming the coffin sides, and end pieces for forming the coffin ends, the base, said pieces and end pieces being integral yet separated by crease lines for folded erection of the coffin, the end pieces each having a pair of lateral extensions which project laterally outwardly from the end pieces on opposite sides thereof for connecting the side and end pieces in the erected coffin by being joined along their side edges, the lateral extensions being folded inwardly of the side pieces, and means for connecting the lateral extensions to respective ones of the side pieces in overlying relation, whereby the extensions support the adjacent side pieces.

2. A coffin according to claim 1 including strengthening strips for adhesion along the upper sides of the sides of the erected coffin, the strips each having a crease line longitudinally along its length for folding the strip into double thickness.

3. A coffin according to claim 2 in which one of the thicknesses of the strips is cut away between the other and the side of the coffin to which it is to adhere so as to provide slots for securing a coffin lid.

4. A coffin according to claim 1 including tapes adhering to the inside or outside of the side pieces and extending through the side pieces for either tieing over the corpse or for supporting coffin handles; or both.

5. A coffin according to claim 2 which includes a coffin lid which fits inside an upper edge of the coffin and is secured to the strengthening strips, the coffin lid having tongues projecting from its periphery for securing in the slots.

6. A coffin according to claim 5 in which the tongues have an edge nearer the foot of the coffin perpendicular to the periphery of the lid, and an edge nearer the head of the coffin inclined at less than 90° to the periphery.

7. A coffin according to claim 5 in which the coffin lid sits below the upper edge of the coffin.

8. A coffin according to claim 5 in which the tongues have slots whereby the lid may be secured to the coffin by the introduction of tags.

9. A coffin according to claim 1 in which the base, side pieces, end pieces and/or extensions are cut out in dove-tailed or mating segments for connection.

10. A coffin erected from a blank cut from a single sheet of a material selected from the group consisting of cardboard, fibre board, straw-type building board or hard board, the blank comprising a base piece for forming the coffin floor, side pieces for forming the coffin sides, and end pieces for forming the coffin ends, the base piece, side pieces and end pieces being integral yet separated by crease lines for folded erection of the coffin, adjacent ones of said pieces having free edges each with dove-tailed or mating segments for mutual connection when the blank is folded to bring said free edges together, said base piece being of the general configuration of the corpse, having a centrally widened portion toward one end, a narrowed head portion having free side edges and a narrowed foot portion, said side pieces each extending along said narrowed head portion and having free side edges along and diverging from the free side edges of the head portion, the respective free side edges each being provided with said dove-tailed or mating segments and being brought together for mutual connection by said segments upon folding the side pieces upwardly from the base, said side pieces each includes longitudinal extensions separated from the side pieces by further crease lines, the extensions each having an outer free edge provided with further dove-tailed or mating segments, the extensions being foldable along the further crease lines for bringing the outer free edges together for mutual connection upon erection of the coffin.

* * * * *